US006450165B1

(12) United States Patent
Silver et al.

(10) Patent No.: US 6,450,165 B1
(45) Date of Patent: Sep. 17, 2002

(54) PERSONAL FIRE SURVIVAL HEAD ENCLOSURE

(75) Inventors: Mitchel Silver; Harlan S. Berger, both of New York, NY (US)

(73) Assignee: Precious Life, LLC, New York, NY (US)

( * ) Notice: Subject to any disclaimer, the term of this patent is extended or adjusted under 35 U.S.C. 154(b) by 0 days.

(21) Appl. No.: 09/383,675

(22) Filed: Aug. 26, 1999

(51) Int. Cl.[7] ..... A62B 18/02
(52) U.S. Cl. ..... 128/206.21; 128/201.22
(58) Field of Search ..... 128/201.22, 201.24, 128/201.25, 201.27, 201.29, 200.24, 205.27, 205.28, 206.16, 206.19, 206.21; 2/173.1, 202, 205, 410, 210.23, 201.25

(56) References Cited

U.S. PATENT DOCUMENTS

| | | | | |
|---|---|---|---|---|
| 682,455 A | | 9/1901 | Cooper | |
| 3,500,033 A | | 3/1970 | Cole, Jr. et al. | |
| 3,638,258 A | | 2/1972 | Black | 9/321 |
| 3,895,625 A | | 7/1975 | DeLest | 128/142 |
| 4,116,237 A | | 9/1978 | Birch | 128/427 |
| 4,173,220 A | | 11/1979 | Ratz et al. | 128/142.7 |
| 4,231,359 A | | 11/1980 | Martin | 128/201.18 |
| 4,236,514 A | * | 12/1980 | Moretti | 128/201.23 |
| 4,382,440 A | * | 5/1983 | Kapp et al. | 128/201.25 |
| 4,627,431 A | | 12/1986 | Werjefelt | 128/201.25 |
| 5,003,973 A | | 4/1991 | Ford et al. | 128/201.25 |
| 5,113,527 A | | 5/1992 | Robertson-McKenzie | 2/7 |
| 5,113,854 A | | 5/1992 | Dosch et al. | 128/201.23 |
| 5,119,808 A | | 6/1992 | Marquardt et al. | 128/201.22 |
| 5,133,344 A | | 7/1992 | Jurrius et al. | 128/201.23 |
| 5,146,636 A | * | 9/1992 | De La Pena | 128/201.25 |
| 5,226,409 A | * | 7/1993 | Bower et al. | 128/201.23 |
| 5,283,911 A | | 2/1994 | DeMars | 2/209.13 |
| 5,323,492 A | | 6/1994 | DeMars | 2/209.13 |
| 5,367,706 A | * | 11/1994 | Davidson | 2/4 |
| 5,421,326 A | | 6/1995 | Rankin et al. | 128/201.19 |
| 5,431,156 A | | 7/1995 | Sundstrom | 128/201.23 |
| 5,452,712 A | * | 9/1995 | Richardson | 128/201.25 |
| 5,483,956 A | | 1/1996 | Shapiro | 128/206.27 |
| 5,655,525 A | * | 8/1997 | Orr | 128/205.25 |
| 5,690,095 A | | 11/1997 | Glynn et al. | 128/201.23 |
| 5,724,958 A | | 3/1998 | Farnworth etal. | 128/201.23 |
| 5,820,530 A | | 10/1998 | Kallassy | 482/111 |
| 5,839,432 A | | 11/1998 | Daneshvar | 128/201.25 |
| 5,875,775 A | * | 3/1999 | Nur et al. | 128/201.28 |
| 6,012,175 A | * | 1/2000 | Johnston | 128/201.25 |

* cited by examiner

*Primary Examiner*—John G. Weiss
*Assistant Examiner*—Teena Mitchell
(74) *Attorney, Agent, or Firm*—Milde & Hoffberg LLP

(57) ABSTRACT

A protective head enclosure for emergency use by a user to protect the respiratory tract and eyes from smoke and/or noxious gases and to protect the head from heat and/or toxic substances. The enclosure comprises a head enclosure made of substantially flexible, gas impermeable, heat and fire retardant sheet material, the enclosure having a closed top; a circular, flexible resilient ring disposed on and attached to the enclosure between its top and bottom, the resilient ring being adapted to be twisted into a double cylindrical coil for packing and storage of the enclosure and snapped open into a single circular ring and thereby open the enclosure for use; a closure for closing the bottom of the enclosure about the neck and/or shoulders of a user after the enclosure has been placed over the user's head. The protective head enclosure may be folded compactly and stored in a container or cabinet ready to use by a single motion, quick release.

20 Claims, 7 Drawing Sheets

PERSONAL FIRE SURVIVAL HEAD ENCLOSURE

FIELD OF THE INVENTION

This invention relates to an emergency device to be worn over a user's head and capable of removing toxic compounds and smoke from the air surrounding the user in the midst of a smoky environment, such as produced by a fire.

BACKGROUND OF THE INVENTION

It has been reported that over 85% of fatalities in fires are caused, not by the heat or the flames, but rather by the inhalation of smoke and noxious gases produced by the fire. Fire is particularly hazardous in confined quarters, such as on an airplane, on a ship, in a high rise sealed building, in a hotel, and most importantly in the user's home. To provide individual short-term protection for a person subjected to smoke and/or toxic gases, a number of devices have been proposed.

Illustrative of the patent literature on hoods to be worn over the head that are capable of providing the user with a more benign atmosphere are the following:

U.S. Pat. Nos. 682,455; 3,895,625; 4,173,220; 4,231,359; 4,627,431; 5,003,973; 5,113,527; 5,113,854; 5,119,808; 5,133,344; 5,421,326; 5,431,156; 5,690,095; 5,724,958; 5,820,530 and 5,839,432. Some of these patents show the state of the art of chemiluminescent sources of light.

U.S. Pat. No. 682,455 describes a hood made of fabric having an opening with means for securing the mouth of the hood about the neck of the wearer. A helmet within the hood has receptacles to contain a chemical which is adapted to combine with the carbon of the products of expiration thereby setting oxygen free.

U.S. Pat. No. 3,500,033 describes a chemiluminescent emergency lighting device that is activated by the admission of an activating gas into a plastic envelope containing the chemiluminescent lighting unit.

U.S. Pat. No. 3,638,258 describes a rescue light for a life support system containing a chemiluminescent lighting element like that mentioned in U.S. Pat. No. 3,500,033, in which the gas also inflated a collapsed tube that contains the chemiluminescent material.

U.S. Pat. No. 3,895,625 describes a head protection enclosure having a hood supported by a frame of rigid elements connected by articulations. The bottom portion of the frame has two handles mounted on opposite sides of the frame. The enclosure is foldable.

U.S. Pat. No. 4,116,237 describes an emergency hood shaped breathing apparatus having a tubular frame, which contains sections that contain oxygen under pressure to be supplied to the wearer.

U.S. Pat. No. 4,173,220 describes a gas mask with a hose connection for attachment to an oxygen source.

U.S. Pat. No. 4,231,359 describes a personal emergency breathing hood having a mouthpiece that extends through the hood for attachment to a breathing apparatus and also having a nose blocking device.

U.S. Pat. No. 4,627,431 describes a protective hood with an alkali metal hydroxide as a $CO_2$ absorbent.

U.S. Pat. No. 5,003,973 describes a rescue helmet apparatus having oxygen canisters, reflective cape, and lithium powered lights.

U.S. Pat. No. 5,113,527 describes a fire and smoke protective hood made from a high temperature-resistant plastic, preferably having a layer of a fluoropolymer, a layer of titanium and a filter to allow the wearer to breathe smoke-free air.

U.S. Pat. No. 5,113,854 describes a hood made of clear TEFLON® having a scrubber canister and an exhaust valve, a neck seal at the lower edge of the hood, and a springlike hoop connected to the lower portion of the hood. A bib is carried by the hoop and supports an oxygen generator that is connected to the scrubber canister by an oxygen supply line. The hood assembly may be stored in a cylindrical container with the hoop collapsed. When the assembly is withdrawn from the container, a lanyard will initiate the operation of the oxygen generator. In addition, chemiluminescent devices attached to the hoop are activated.

U.S. Pat. No. 5,119,808 describes a respirator having a hood with a respiratory connection to a chemical that absorbs water vapor and $CO_2$ and releases oxygen. The hood has a protective covering of a coated fabric.

U.S. Pat. No. 5,133,344 describes a protective hood connectable to a source of oxygen and having an inflatable collar to support the weight of the hood on the user's shoulders and preferably containing a number of air holes that provide air to the wearer.

U.S. Pat. No. 5,283,911 and 5,323,492 describe a cap with a plastic light tube attached to it.

U.S. Pat. No. 5,421,326 describes a heat-resistant suit having an inner garment designed to circulate cooling air against the user's body.

U.S. Pat. No. 5,431,156 describes a combined half mask and hood type protective respiratory device having an air filter and an elastic sleeve to surround the wearer's neck.

U.S. Pat. No. 5,483,956 describes a stationary box having an electrical cord plugged into an electrical outlet to power an emergency light on the top of the box so that it may be readily located in an emergency. Inside the box is a charger that constantly charges a battery- operated light on a protective hood.

U.S. Pat. No. 5,690,095 describes an emergency escape breathing apparatus having supply means by which respirable air may be provided to an inner mask of the hood.

U.S. Pat. No. 5,724,958 describes a breathing apparatus for survival gear having a hood which is sealed over the head of a user. The hood has sufficient volume to allow the user to breathe for a limited period of time and is made of a material that does not allow the passage of water through it but does allow the passage of gases, thereby allowing the passage of oxygen in the hood and the exit of carbon dioxide out of the hood.

SUMMARY OF THE INVENTION

It is an object of the current invention to provide an improved protective head enclosure for emergency use.

It is an object of the current invention to provide an improved protective head enclosure that protects the respiratory tract and eyes from smoke and/or noxious gases and the head from heat and/or toxic substances.

It is a further object of the current invention to provide an improved protective head enclosure that may be stored unused in a compact container.

It is an object of the invention to provide an improved protective head enclosure that may be instantly released by a single motion from its container ready to wear in an emergency.

These objects and others that will become apparent from the following specification are achieved by an improved protective head enclosure for emergency use by a user to protect the respiratory tract and eyes from smoke and/or noxious gases and to protect the head from heat and/or toxic substances, which comprises in combination:

(a) a head enclosure made of substantially flexible, gas impermeable, heat and fire retardant sheet material, said enclosure having a closed top;

(b) a circular, flexible resilient ring disposed on and attached to said enclosure between said top and said bottom, said resilient ring being adapted to be twisted into a double cylindrical coil for packing and storage of the enclosure and snapped open into a single circular ring to open said enclosure for use;

(c) means for closing the bottom of said enclosure about at least one of the neck and shoulders of a user after said enclosure has been placed over the user's head.

The head enclosure may be substantially cylindrically shaped. The sheet material forming the enclosure may be comprised of a plastic, preferably a high-temperature resistant polymer, e.g., a polyimide, which may be coated with polytetrafluroethylene. The resilient ring and the enclosure may be approximately one foot (up to 14") in diameter when the resilient ring is configured in a single ring, and the resilient ring and the enclosure may be reduced to approximately six inches in diameter when the resilient ring is twisted into a double coil and folded over. The resilient ring may be made of resilient plastic tubing, metal wire or any material suitable to create the desired snap reaction to open the folded enclosure as further described hereinafter. The flexible filter is preferably disposed on and attached to the enclosure, permitting the passage of filtered air therethrough, from the exterior to the interior of the enclosure. The filter is preferably attached to the enclosure in the region in front of the mouth and nose of the user, when the enclosure is in place on a user's head. The filter is preferably comprised of a material that filters out smoke and/or noxious gases, e.g., activated carbon. The filter may additionally contain a catalytic converter, e.g., a Hopcalite catalytic converter that converts toxic carbon monoxide to non-toxic carbon dioxide. The filter 15 may additionally contain a Zeolite molecular sieve layer 30 that absorbs moisture and acid gases. The closing means may include at least one stretchable, closed band disposed on and attached to said enclosure, near the bottom of the enclosure. Two stretchable, preferably closed, bands may be provided in spaced relation on the enclosure. The head enclosure may further comprise a means for providing illumination when the enclosure is opened or activated. The illumination means may be a chemiluminescent element. The chemiluminescent element may include a translucent tube and chemiluminescent liquids or gases disposed in the tube. The chemiluminescent liquids may be released for mixing when the resilient ring is opened from a double coil to a single coil. The head enclosure may be stored in a quick-release package.

PREFERRED EMBODIMENTS OF THE INVENTION

Figure 1:
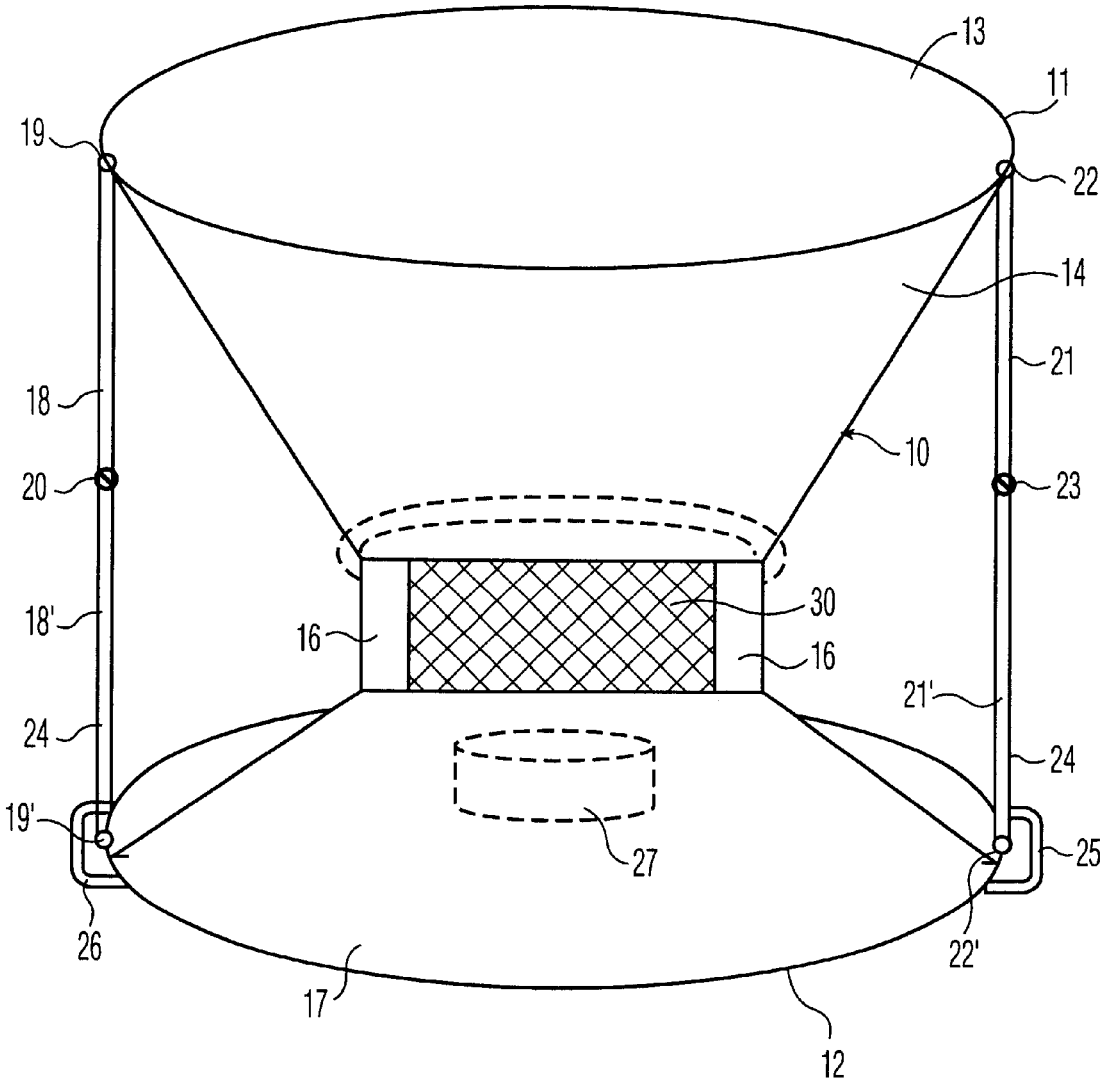
FIG. 1 illustrates one embodiment of the protective hood enclosure of the invention in the ready-to-use mode for a user to insert his or her head into the bottom of the enclosure.

In the FIGS., the same or similar components are indicated by the same or similar reference numerals in order to simplify and clarify the accompanying description.

FIG. 1 illustrates a preferred embodiment of the protective head enclosure 10 of the invention. At the top of enclosure 10 is flexible resilient ring 11, and at the bottom of the head enclosure 10 is flexible resilient ring 12. The resilient rings 11 and 12 may be made of any suitable material, plastic or metal, preferably in the form of plastic tubing or metal wire. For metal, a spring steel wire is suitable. Spanning the plane of flexible resilient ring 11 is a strong heat resistant material 13, preferably non-transparent. This surface can be used as a shield so that one can go head down through active flames. Extending downward from flexible resilient ring 11 is transparent sheet material 14, preferably in the general form of a frustum. The transparent sheet material 14 allows viewing through the protective head enclosure 10. Any suitable high temperature resistant transparent material may be used. Suitable materials are any of the high-temperature resistant plastics, preferably polyimides, most preferably, Teflon(® -coated Kapton® polyimides available from DuPont. Extending downward from the bottom of the transparent sheet material 14, a filter 15 is positioned to cover the nose and/or the mouth of the user. Extending from the sides of filter material 15 is elastic segment 16, which may complete the circumference or may just be a panel to provide adjustability to fit the user's head circumference at the nose and mouth area. If elastic segment 16 does not complete the circumference, the circumference may be completed by any suitable material, e.g., transparent sheet material 14. When used, the narrow midsection of the hourglass-shaped hood enclosure 10 maintains the filter over the wearer's nose and/or mouth so that the filter is more effective. Base 17 extends downward from filter material 15 and elastic panel 16 (and any other material completing the circumference) and across the circumference of flexible resilient ring 12 in the shape of an annulus. Extending on the left side between the flexible resilient ring 11 and the flexible resilient ring 12 are collapsible arms 18 and 18', which are articulated at 19 and 19' by spring hinges that are biased in the 90° position and spring hinge 20 which is biased in the 180° position. This arrangement is mirrored on the right side of FIG. 1. Extending on the right side between the flexible resilient ring 11 and the flexible resilient ring 12 are collapsible arms 21 and 21', which are articulated at 22 and 22' by spring hinges which are biased in the 90° position and spring hinge 23 which is biased in the 180° position. The collapsible arms 18, 18', 21 and 21' may contain fluorescent neon fluid 24, which when the protective head enclosure 10 is opened, may be mixed to provide a chemiluminescent light so that the wearer of a protective head enclosure 10 may be seen by rescuers in a smoky, dark environment. Attached to right side of flexible resilient ring 12 is fixed handle 25 preferably made of photo luminecent material or coated with such material and on the left side folding handle 26. Handle 26 is made to fold so that when the embodiment 10 is collapsed, handle 25 may be grasped and embodiment 10 may spring open ready for use when it is removed from a container. Elastic band 27 allows the user to don the protective head enclosure 10 by inserting his or her head into elastic band 27. There may or may not be a membrane to pierce across the opening formed by elastic band 27, which, if present, additionally serves to seal the protective head enclosure 10 around the user's neck.

Figure 2:
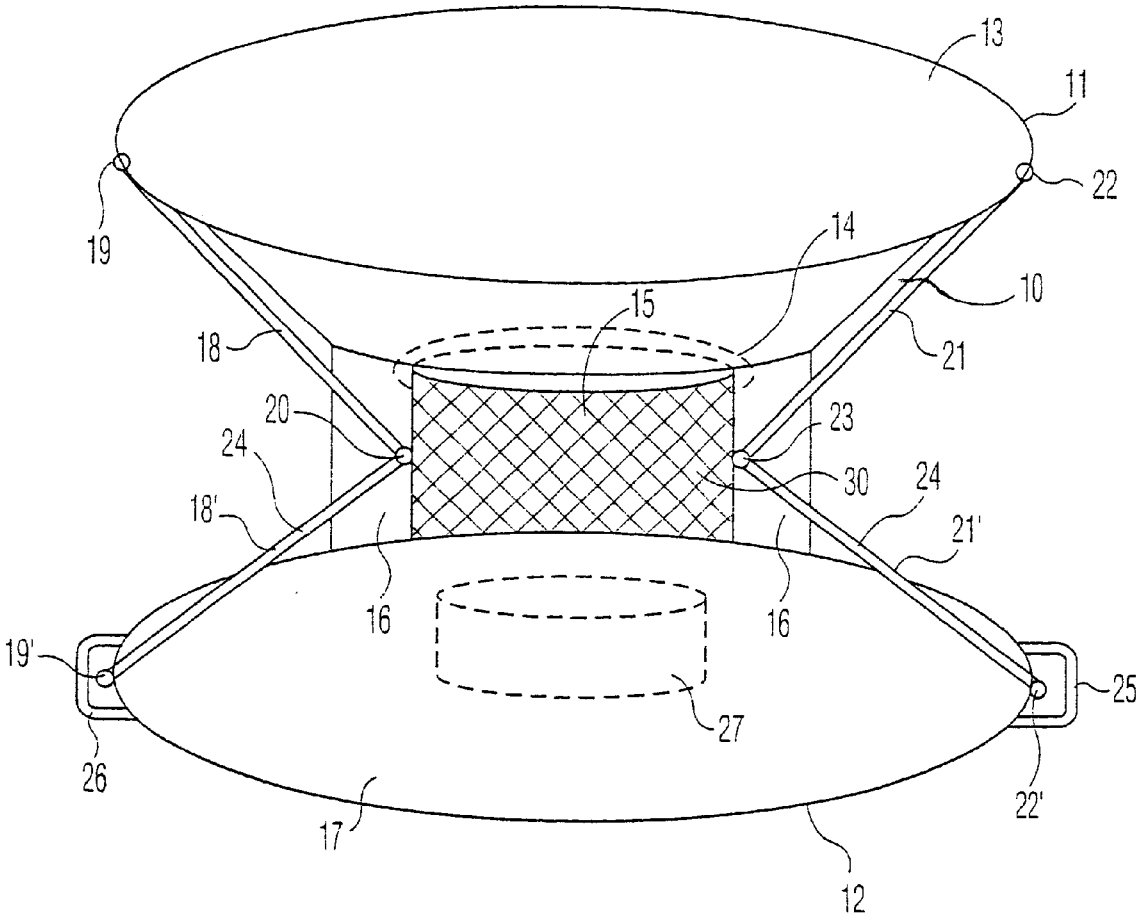
FIG. 2 illustrates the embodiment shown in FIG. 1 in a partially collapsed state.
Figure 3:
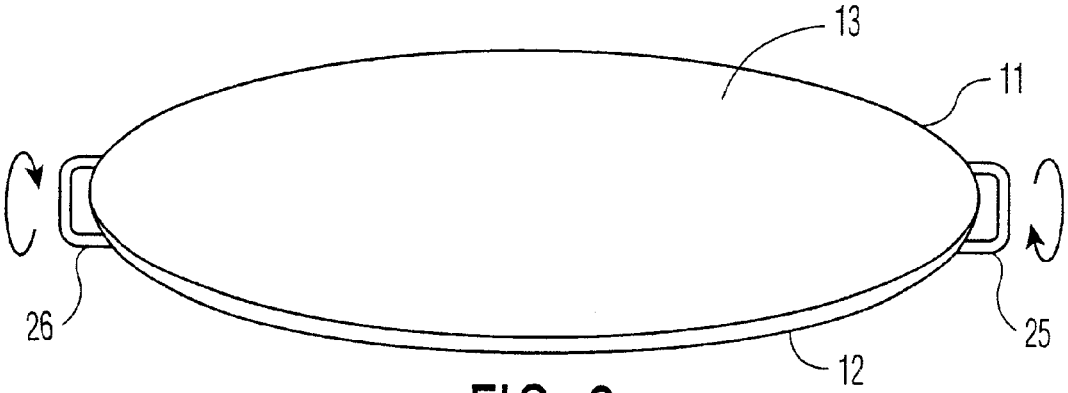
FIG. 3 illustrates the embodiment shown in FIG. 2 in a totally collapsed state.
Figure 4:
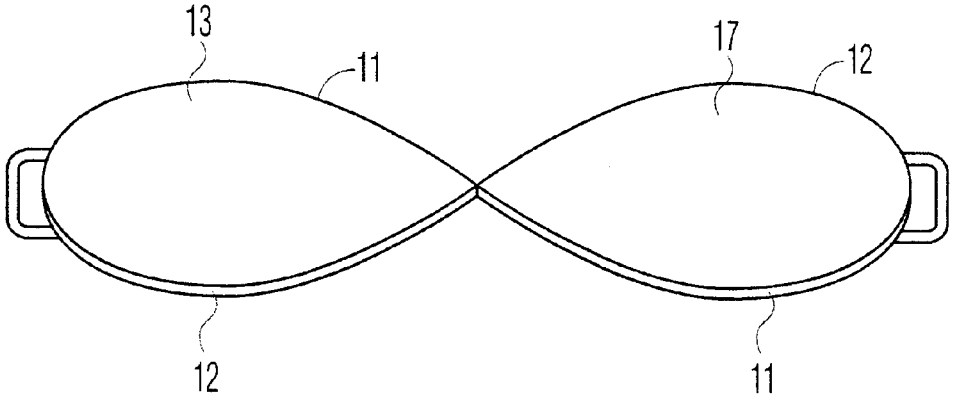
FIG. 4 illustrates the embodiment shown in the collapsed state in FIG. 3, wherein the rings have been twisted to form a figure eight.
Figure 5:
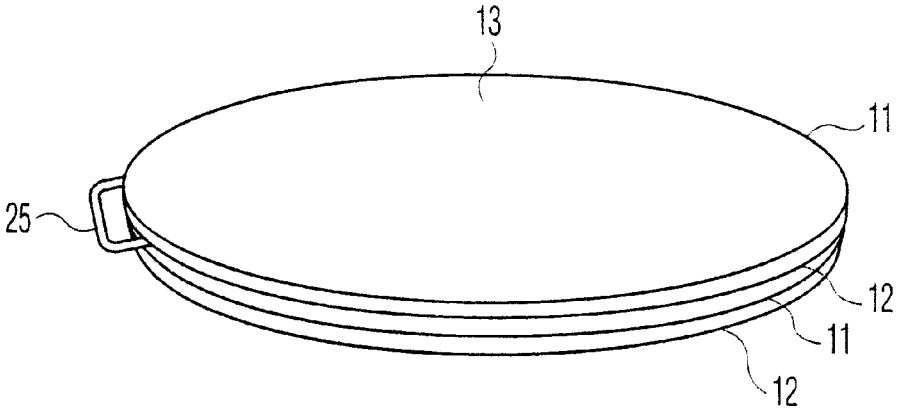
FIG. 5 illustrates the embodiment shown in the collapsed state in FIG. 4, which is then folded over to produce a compact storable item of half the diameter of the device when it is in use.

FIG. 2 is a partially collapsed version of the embodiment illustrated in FIG. 1. In FIG. 3, the partially collapsed version illustrated in FIG. 2 is shown in the fully collapsed state, wherein rings 11 and 12 may be rotated to form a figure eight where the rings cross at their midpoints as Shown in FIG. 4 and then folded over from one side to the other as shown in FIG. 5 to form a fully collapsed, stacked, compact version of the preferred embodiment of the invention, which is half the diameter and easily stored. This is the state in which the product would be produced and which the user would snap open into the state shown in FIG. 1 in the event of an emergency requiring its use.

Figure 6:
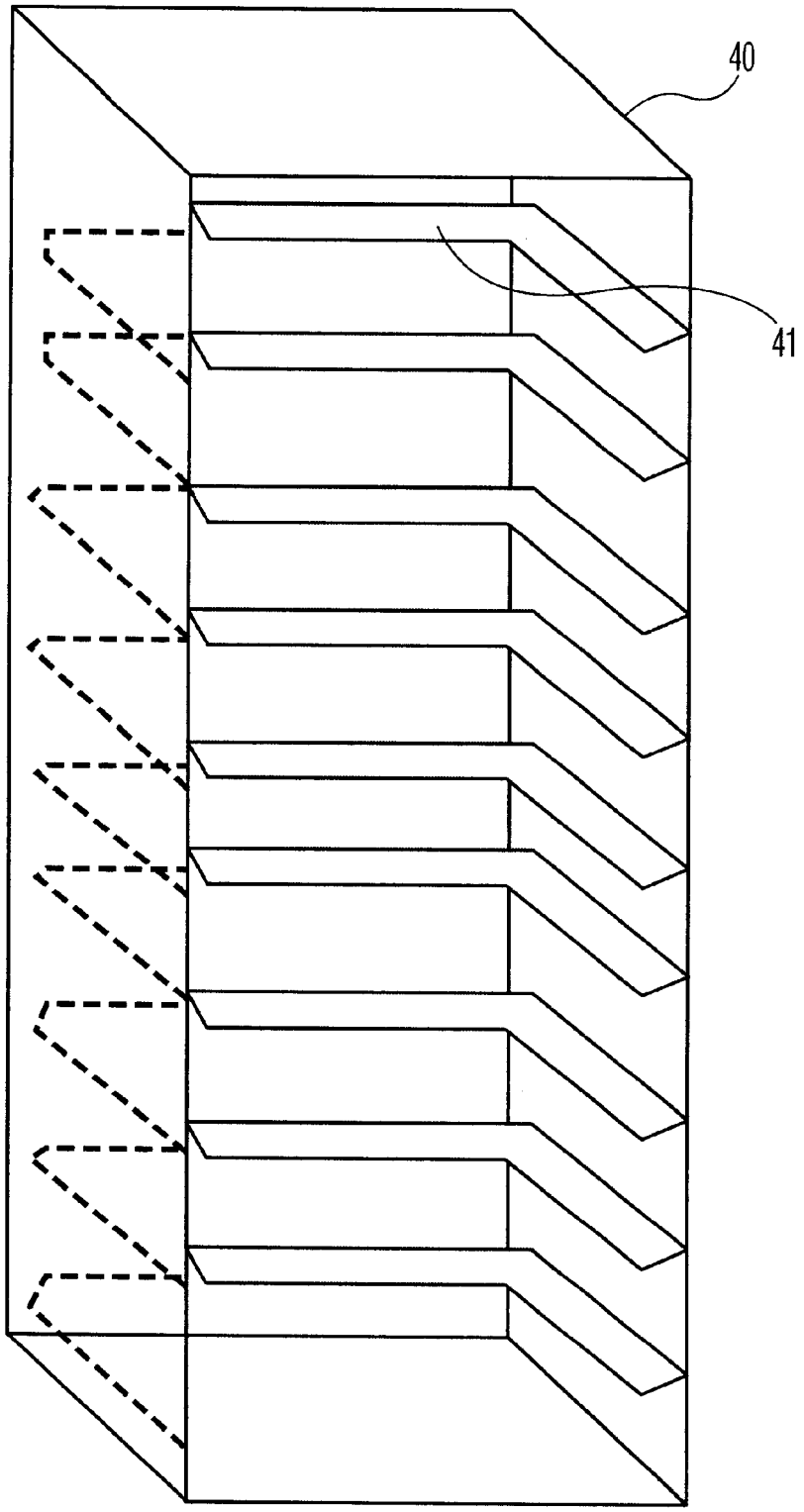
FIG. 6 is a perspective view of a cabinet in which several of the folded-over embodiments shown in FIG. 5 may be contained.

FIG. 6 is a perspective view of a cabinet 40 in which several of the folded-over embodiment 10 shown in FIG. 5 may be contained. Cabinet 40 has partial shelves 41 on which the embodiments 10 may be contained.

Figure 7:
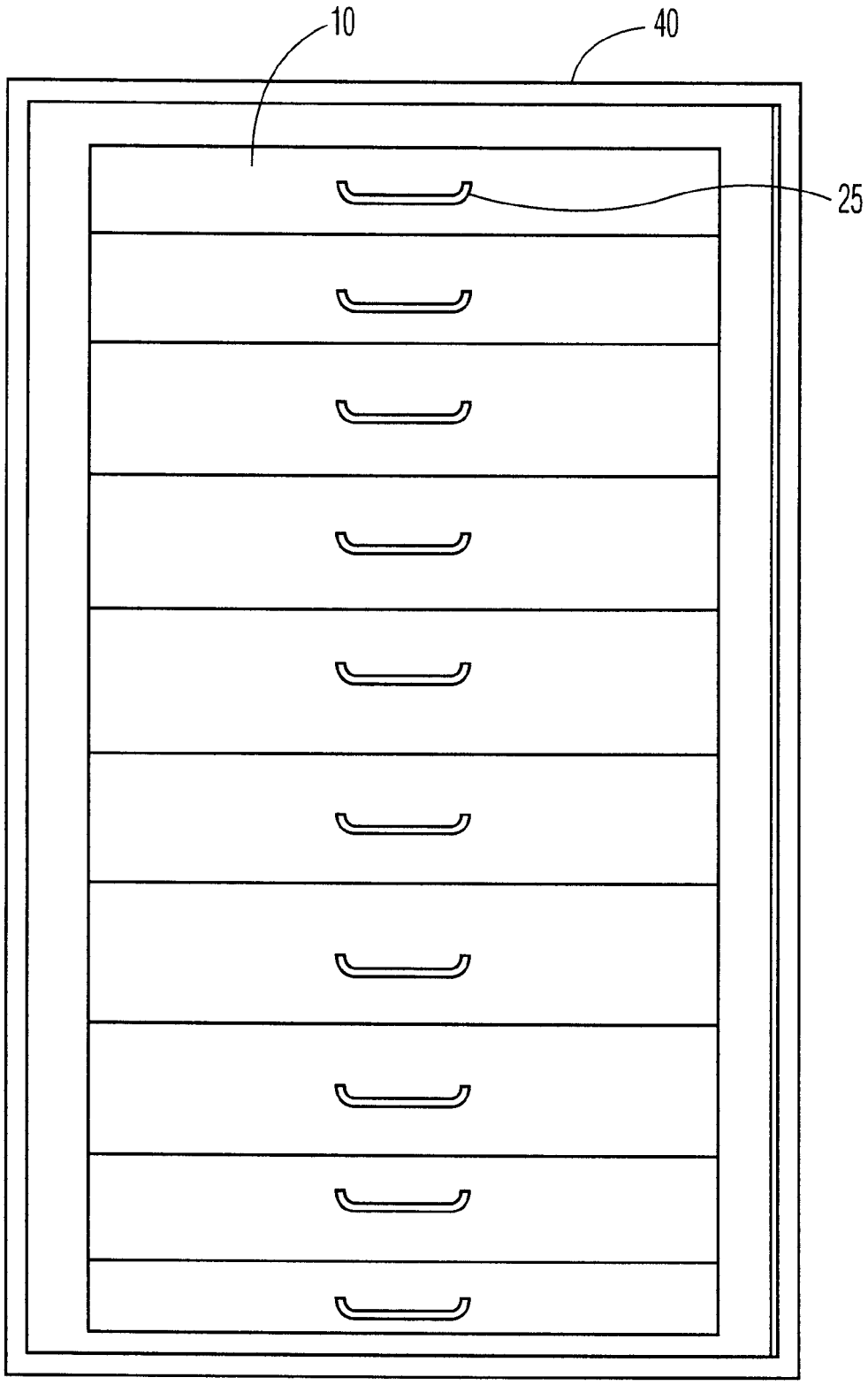
FIG. 7 is a front view of the cabinet of FIG. 6 which contains a number of the embodiments illustrated in FIG. 5.

FIG. 7 is a front view of the cabinet 40 of FIG. 6 which contains a number of the embodiments 10 illustrated in FIG. 5. Although the cabinet 40 contains ten of the embodiments 10, only the top one is identified. The embodiments 10 have handles 25 available for their ease of removal.

Figure 8B:
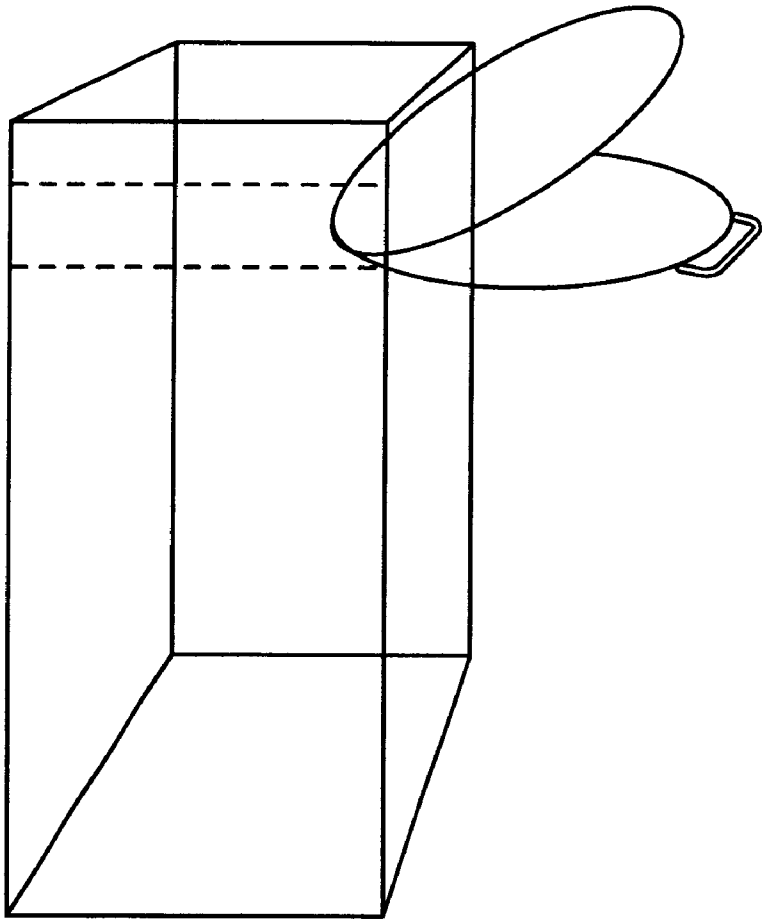
FIG. 8B is another simplified perspective view like that of FIG. 8A, but with one of the embodiments of FIG. 5 pulled part way out of the cabinet. The embodiment is shown as it starts to snap open.
Figure 8A:
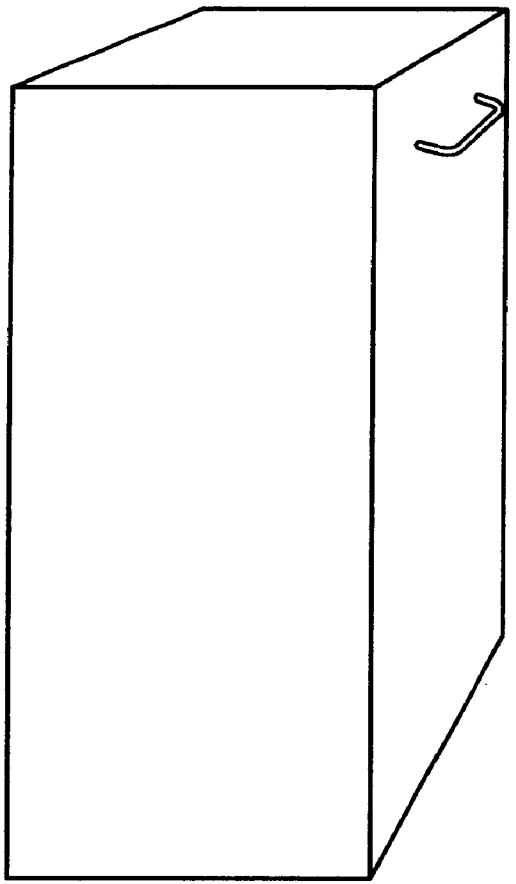
FIG. 8A is a perspective view of the cabinet of FIG. 7, which again for the sake of simplicity only shows the handle of one of the embodiments of FIG. 5.

FIG. 8A is a perspective view of the cabinet 40 of FIG. 7, which for the sake of simplicity only shows the handle 25 of one of the embodiments 10 of FIG. 5.

FIG. 8B is another simplified perspective view like that of FIG. 8A, but with one of the embodiments 10 of FIG. 5 pulled part way out of the cabinet 40 by grasping handle 25. The embodiment 10 is shown as it starts to snap open.

Figure 8D:
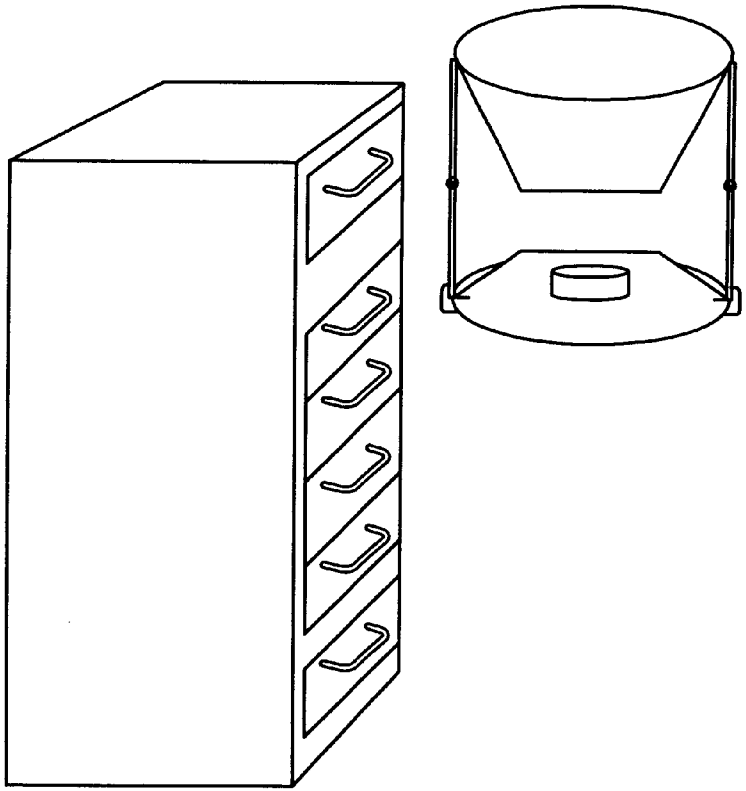
FIG. 8D is the next progression view in which the embodiment of FIG. 5 has totally snapped open into the ready to use embodiment of FIG. 1.
Figure 8C:
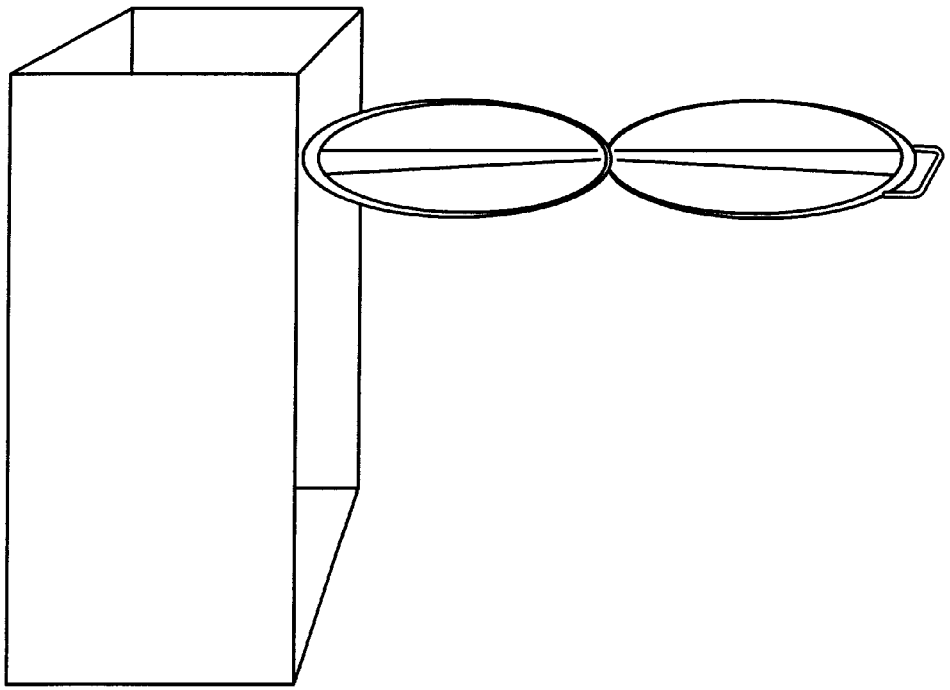
FIG. 8C is a progression view of FIG. 8B with the embodiment of FIG. 5 pulled all the way out of the cabinet so that it is in the metastable figure-eight configuration illustrated in FIG. 4.

FIG. 8C is a progression view of FIG. 8B with the embodiment 10 of FIG. 5 pulled all the way out of the cabinet 40 so that it is in the metastable figure-eight configuration illustrated in FIG. 4.

FIG. 8D is the next progression view in which the embodiment 10 of FIG. 5 has totally snapped open into the ready-to-use embodiment 10 of FIG. 1. The remainder of embodiments 10 are ready at a moment's notice to be pulled out of cabinet 40 by grasping handles 25.

The embodiments 10 may be retained in cabinet 40 by a means (not shown), which, when broken or removed, sounds an alarm and/or sends a signal to a fire station or airport control tower.

If the sequence of FIGS. 8A to 8D is run in reverse, it illustrates the way the embodiment 10 may be twisted, folded over and stored in the cabinet 40.

When used, the narrow midsection of the hourglass shaped hood enclosure 10 maintains the filter over the wearer's nose and/or mouth so that the filter is more effective.

The foregoing specification and drawings have thus described and illustrated a novel protective head enclosure which fulfills all the objects and advantages sought therefor. Many changes, modifications, variations and other uses and applications of the subject invention will, however, become apparent to those skilled in the art after considering this specification which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. A protective head enclosure for emergency use by a user to protect the respiratory tract and eyes from smoke and/or noxious gases and to protect the head from heat and/or toxic substances, said enclosure comprising, in combination:

(a) a head enclosure made of substantially flexible, gas impermeable, heat and fire retardant sheet material, said enclosure having a closed top and an open bottom;

(b) a frame structure having a flexible resilient ring disposed on and attached to said head enclosure on said top and a flexible resilient ring disposed on and attached to said bottom, at least one of said resilient rings being adapted to be twisted into a multiple cylindrical coil for packing and storage of said head enclosure, and snapped open into at least one single circular ring to open said enclosure for use;

(c) spring action, rigid exterior arms which provide separation between said bottom and said top; and (d) means for closing the bottom of said head enclosure about at least one of the neck and shoulders of a user after said enclosure has been placed over the user's head.

2. The head enclosure as claimed in claim 1, wherein said head enclosure has a surface across the top which is comprised of substantially higher heat resistant material, for head down motion through flames.

3. The head enclosure as claimed in claim 1, wherein said sheet material forming the said head enclosure is a polyimide.

4. The head enclosure as claimed in claim 3, wherein the polyimide is coated with polytetrafluroethylene.

5. The head enclosure as claimed in claim 1, wherein said at least one resilient ring is made of resilient plastic tubing, metal wire or any material having suitable properties to open the double coil formed from the said at least one resilient ring.

6. The head enclosure as claimed in claim 1, wherein a flexible filter is disposed on and attached to said head enclosure having an interior and an exterior, permitting the passage of air therethrough, from the exterior to the interior of said head enclosure.

7. The head enclosure as claimed in claim 1, wherein said filter is attached to said head enclosure in the region in front of a mouth and/or nose of a user when the said head enclosure is in place on the user's head.

8. The head enclosure as claimed in claim 7, wherein a stretchable band is provided to keep the filter in close proximity to a mouth and/or nose of a user in spaced relation on said head enclosure.

9. The head enclosure as claimed in claim 7, wherein said filter is comprised of activated carbon.

10. The head enclosure as claimed in claim 7, wherein there is additionally present a catalytic converter capable of converting toxic carbon monoxide to carbon dioxide.

11. The head enclosure as claimed in claim 10, wherein the catalytic converter is a Hopcalite catalytic converter.

12. The head enclosure as claimed in claim 7, wherein the filter also contains a Zeolite molecular sieve layer that absorbs moisture and acid gases.

13. The head enclosure as claimed in claim 1, wherein said closing means includes at least one stretchable, closed band disposed on and attached to said head enclosure, at the said bottom of the enclosure.

14. The head enclosure as claimed in 1, further comprising means for providing illumination when said enclosure is in place on a user's head, said illumination being activated by opening of said head enclosure.

15. The head enclosure as claimed in claim 14, wherein said illumination means is a chemiluminescent element.

16. The head enclosure as claimed in claim 15, wherein said chemiluminescent element includes a translucent tube and chemiluminescent liquids disposed in said tube.

17. The head enclosure as claimed in claim 16, wherein said chemiluminescent liquids are released for mixing when a resilient ring is opened from a double coil to a single coil.

18. The head enclosure as claimed in claim 1, which is twisted and folded into a collapsed, compact unit of substantially smaller size.

19. The head enclosure as claimed in claim 18, which is placed into a cabinet delivery system.

20. One or more head enclosures as claimed in claim 19, which are held in their collapsed form by a cabinet rack delivery system and which open in reaction to being removed from the rack system.

* * * * *